US006578991B2

(12) United States Patent
Beaumont

(10) Patent No.: US 6,578,991 B2
(45) Date of Patent: Jun. 17, 2003

(54) BULB COOLING

(75) Inventor: Matt Beaumont, Ipswich (GB)

(73) Assignee: Light and Sound Design Ltd., Birmingham (GB)

( * ) Notice: Subject to any disclaimer, the term of this patent is extended or adjusted under 35 U.S.C. 154(b) by 0 days.

(21) Appl. No.: 09/778,991

(22) Filed: Feb. 1, 2001

(65) Prior Publication Data

US 2001/0022727 A1 Sep. 20, 2001

Related U.S. Application Data

(60) Provisional application No. 60/179,981, filed on Feb. 3, 2000.

(51) Int. Cl.[7] ..... F21V 7/20

(52) U.S. Cl. ..... 362/345; 362/294; 362/218; 362/264

(58) Field of Search ..... 362/294, 245, 362/273, 218, 264, 345, 373; 313/35, 36, 113

(56) References Cited

U.S. PATENT DOCUMENTS

| | | | | |
|---|---|---|---|---|
| 3,626,176 A | | 12/1971 | Tsugami | 362/294 |
| 4,630,182 A | * | 12/1986 | Moroi et al. | 362/294 |
| 5,372,781 A | * | 12/1994 | Hallett et al. | 422/186.3 |
| 5,746,495 A | * | 5/1998 | Klamm | 362/183 |
| 5,947,592 A | | 9/1999 | Barlow | 362/345 |

* cited by examiner

*Primary Examiner*—Sandra O'Shea
*Assistant Examiner*—Guiyoung Lee
(74) *Attorney, Agent, or Firm*—Fish & Richardson P.C.

(57) ABSTRACT

A system and method of cooling a bulb of a type that requires cooling in one part, but not in others. A deflector assembly is coupled through a reflector, to the bulb, to cool only one part.

16 Claims, 6 Drawing Sheets

BULB COOLING

CROSS-REFERENCE TO RELATED APPLICATIONS

The present application claims benefit to U.S. Provisional application Ser. No. 60/179,981, filed Feb. 3, 2000.

BACKGROUND

The present application relates for special techniques for cooling a special kind of bulb.

Special metal halide bulbs have special cooling requirements. The bulbs, such as Philips metal halide projection lamps, often have a central portion which emits light, and two "pinch" portions around the central portion.

A diagram of an exemplary one of these bulbs is shown in FIG. 1. The bulb has a central light emitting portion 100, and the two surrounding "pinch" portions 102, 104.

In some bulbs, it is desirable to keep the pinch portions 102, 104 cooler than the center portion. This is easy to do in a laboratory condition, but more difficult to do in practice.

SUMMARY

While it may be possible easy to cool only an edge and not the center in a laboratory, the inventor recognized that doing this in practicality can be more difficult. For example, in a laboratory, the bulbs are often cooled using pipes of air. Those pipes could get in the way of the light output from the bulb, and/or the bulb's reflector. Therefore, it has been difficult to cool these kinds of bulbs.

The present application teaches a way of cooling a bulb of this type, by cooling only a pinch portion, and not the center portion. This is done by using a special combination of structure that cools at least one of the edges, but does not cool the center.

BRIEF DESCRIPTION OF THE DRAWINGS

These and other aspects will be described in detail with reference to the drawings in which.

DESCRIPTION OF THE PREFERRED EMBODIMENT

Figure 1:
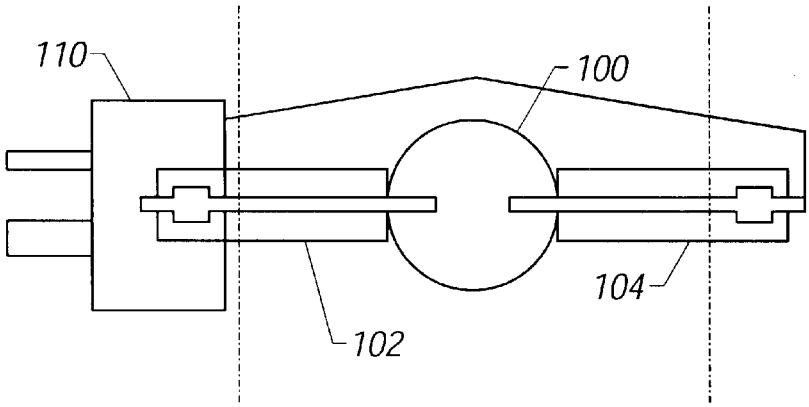
FIG. 1 shows a pinch-type bulb.

A bulb of the preferred type is shown in FIG. 1. This bulb has a central portion 100 which emits light, and edge portions 102, 104, at least one of which need to be cooled. The central portion 100, which emits the light, is preferably not cooled. The bulb used herein is called an MSR SA, or short arc discharge bulb. Other bulbs have similar cooling requirements.

Figure 2:
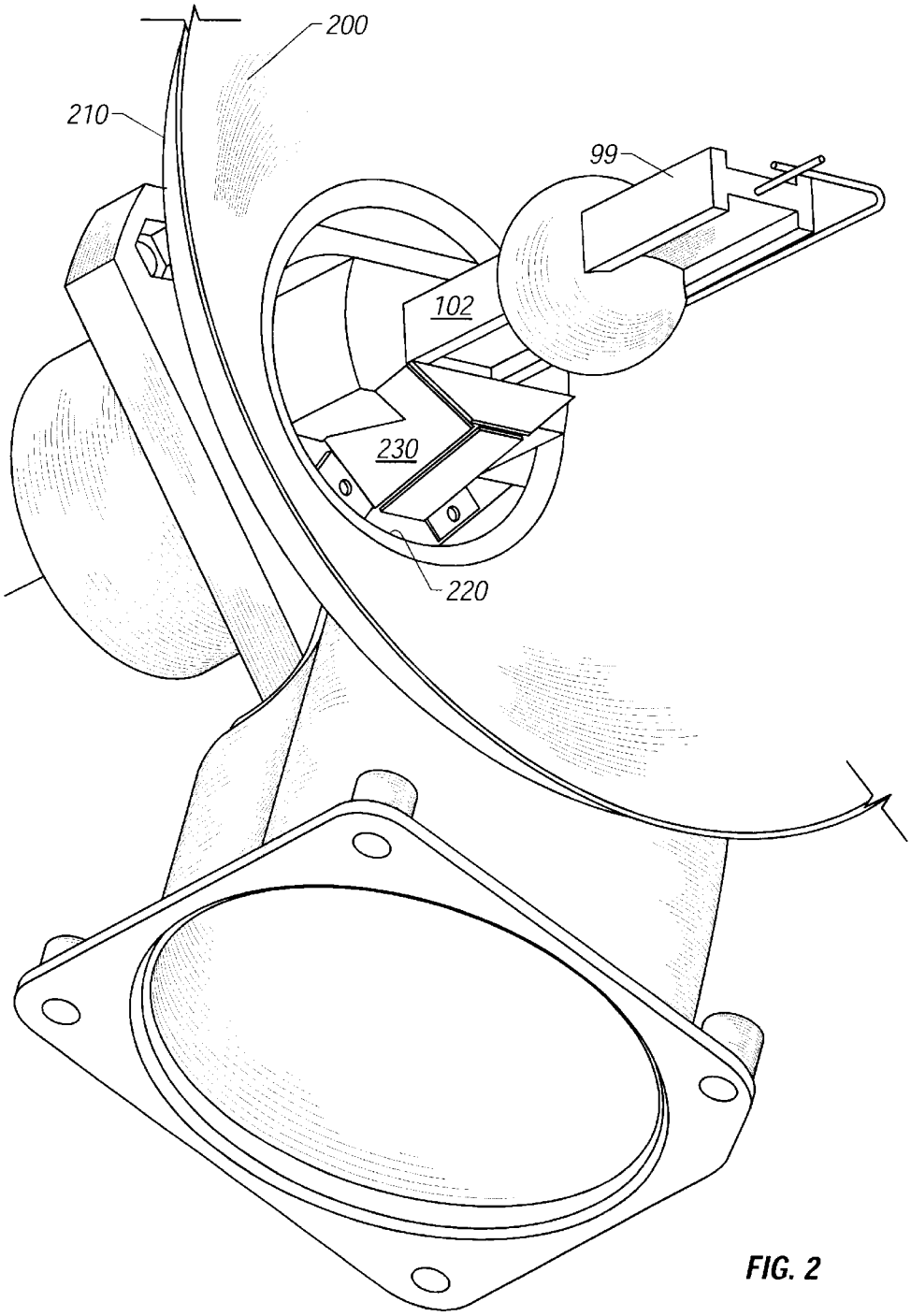
FIG. 2 shows the bulb relative to a portion of the reflector.

The edge portions 102, 104 should preferably be kept between 400 and 450° C. The bulb is mounted as shown in FIG. 2. When mounted in this way, the far edge portion 104 is often sufficiently cooled by ambient to be kept within the desired range. However, the near edge portion 102 gets very hot, due to the proximity to the ceramic base 110 and also because of its electrical connection. Also, as described above, cooling should not, or should only minimally, touch the center portion 100.

FIG. 2 shows the bulb 99 placed relative to a portion of the reflector 200. The base portion 110 of the bulb is shown connected. The reflector 200 includes an outer edge 210 and an inner edge 220. A metal air deflecting portion 230 fits within the inner edge 220, and directs air from a fan to the close pinch portion 102 of the bulb which is close to the reflector.

Figure 3:
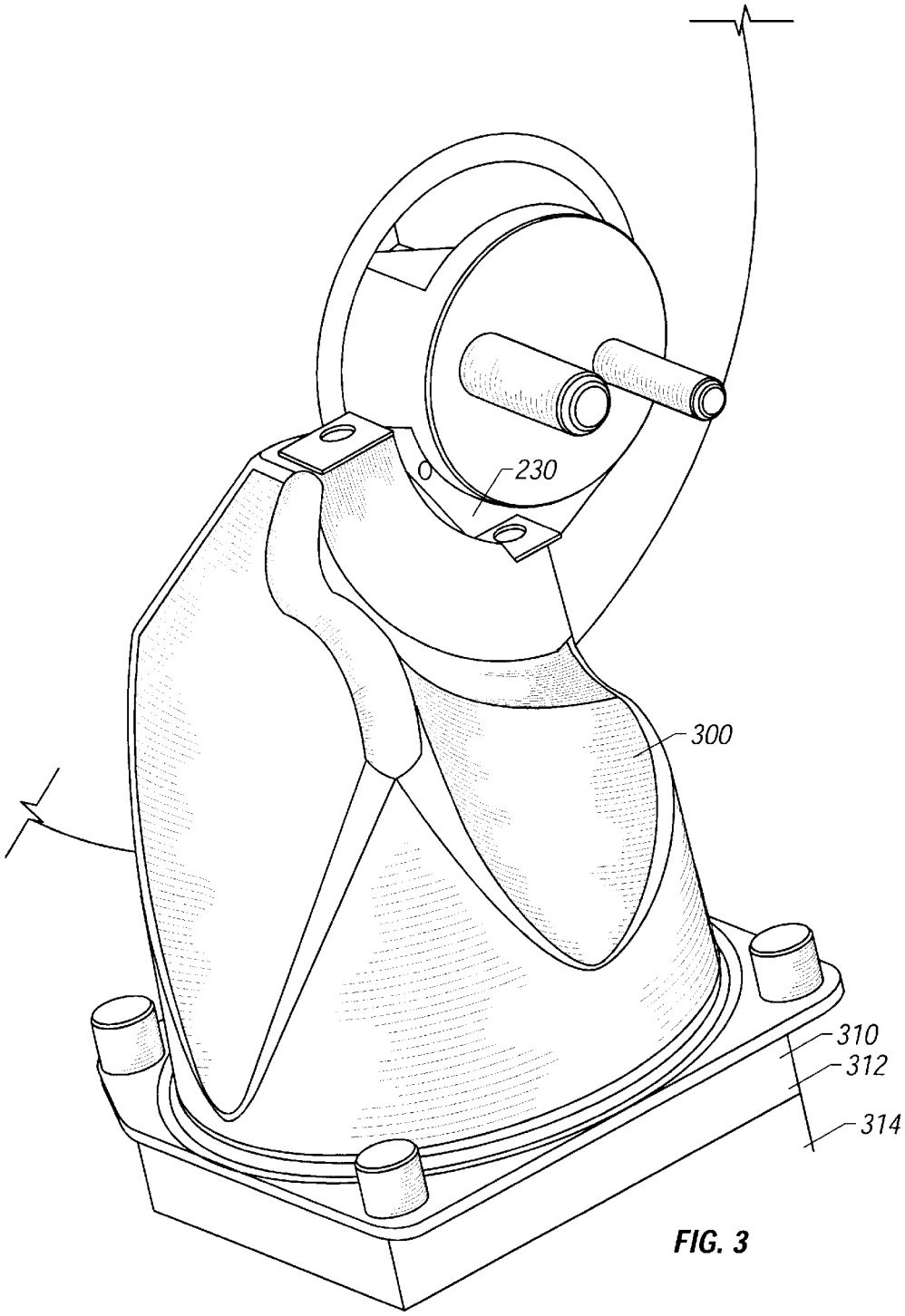
FIG. 3 shows the rear of the reflector and the fan assembly.

FIG. 3 shows the rear view of the system. An air chamber 300 is attached to a fan assembly shown generically as 310. The fan assembly 310 forces into the air assembly 300, and through the air coupling mechanisms 230, to eventually end up at the bulb. Further detail is shown in the other Figures.

Figure 5:
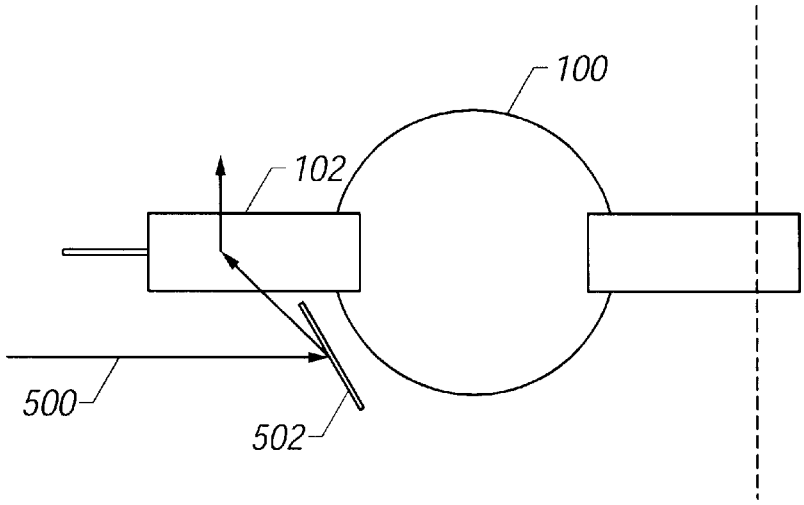
FIG. 5 shows air flow over the pinch, from the side.
Figure 4:
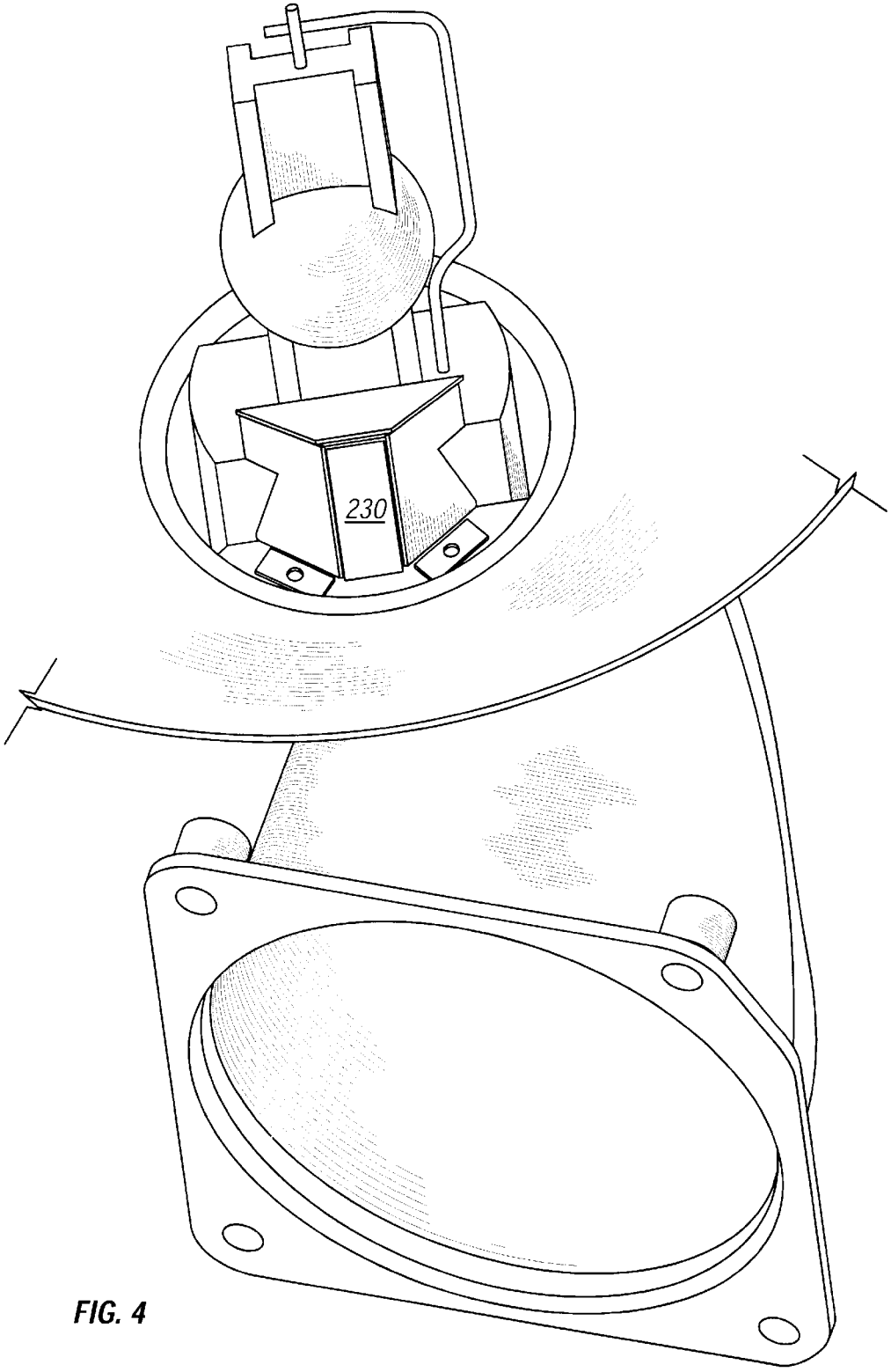
FIG. 4 show the bulb/reflector from the bottom, showing the special interface piece.

FIG. 4 shows more detail of the shape of the air deflection assembly. FIG. 5 shows schematically how the air is coupled. The air couples through the assembly as 500. It hits the far end wall 502 of the air coupling assembly 230. This air is then deflected back towards the near pinch 102, and travels thereover, cooling the near pinch 102 as it passes. The air is traveling away from the main portion of the bulb. In this system, the air preferably travels from the central portion towards the pinch.

Figure 6:
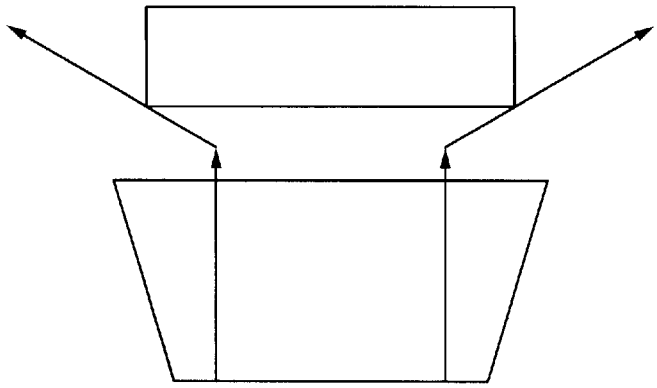
FIG. 6 shows air flow over the pinch from the orthogonal direction as FIG. 5.

FIG. 6 shows a cross-section along the line 5—5 in FIG. 5. The air travels outwardly, as shown, and hence again travels away from the pinch portion.

Figure 7:
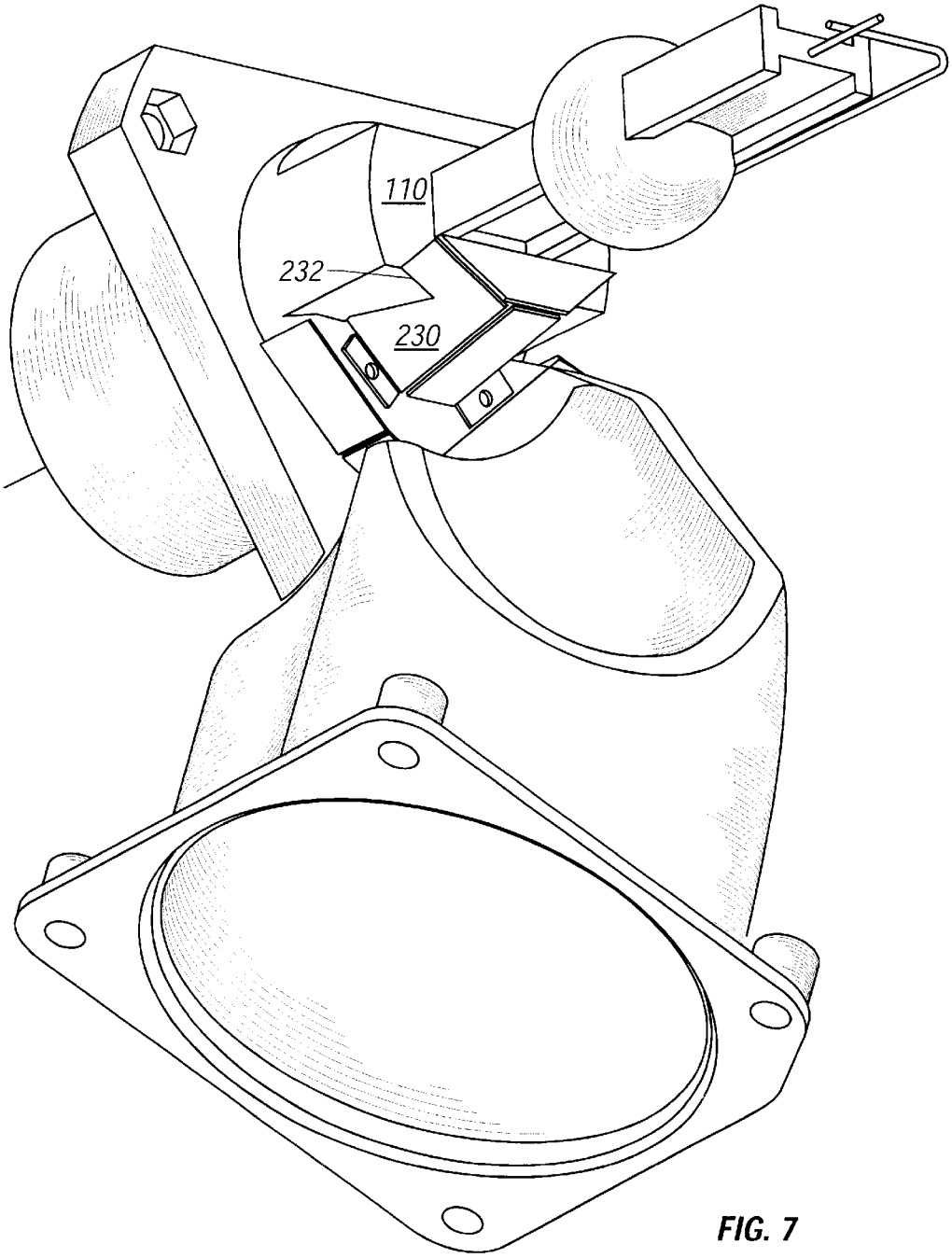
FIG. 7 shows the bulb with the reflector removed.

FIGS. 5 and 6 show the air chimney defined by the metal pieces 230. These pieces are aligned relative to the bulb. The alignment is shown in more detail in FIG. 7 which shows the air producing assembly 230, held in place relative to the bulb. The alignment can be via connection to the reflector in a way that holds the chimney relative to the desired cooled area of the bulb. It can be, alternatively, held by a clip that is placed around the bulb. The air producing assembly includes inner surfaces 232 which are adapted to press against the face 110, to hold the air deflection assembly in place relative to the bulb or the bulb's expected position.

Figure 8:
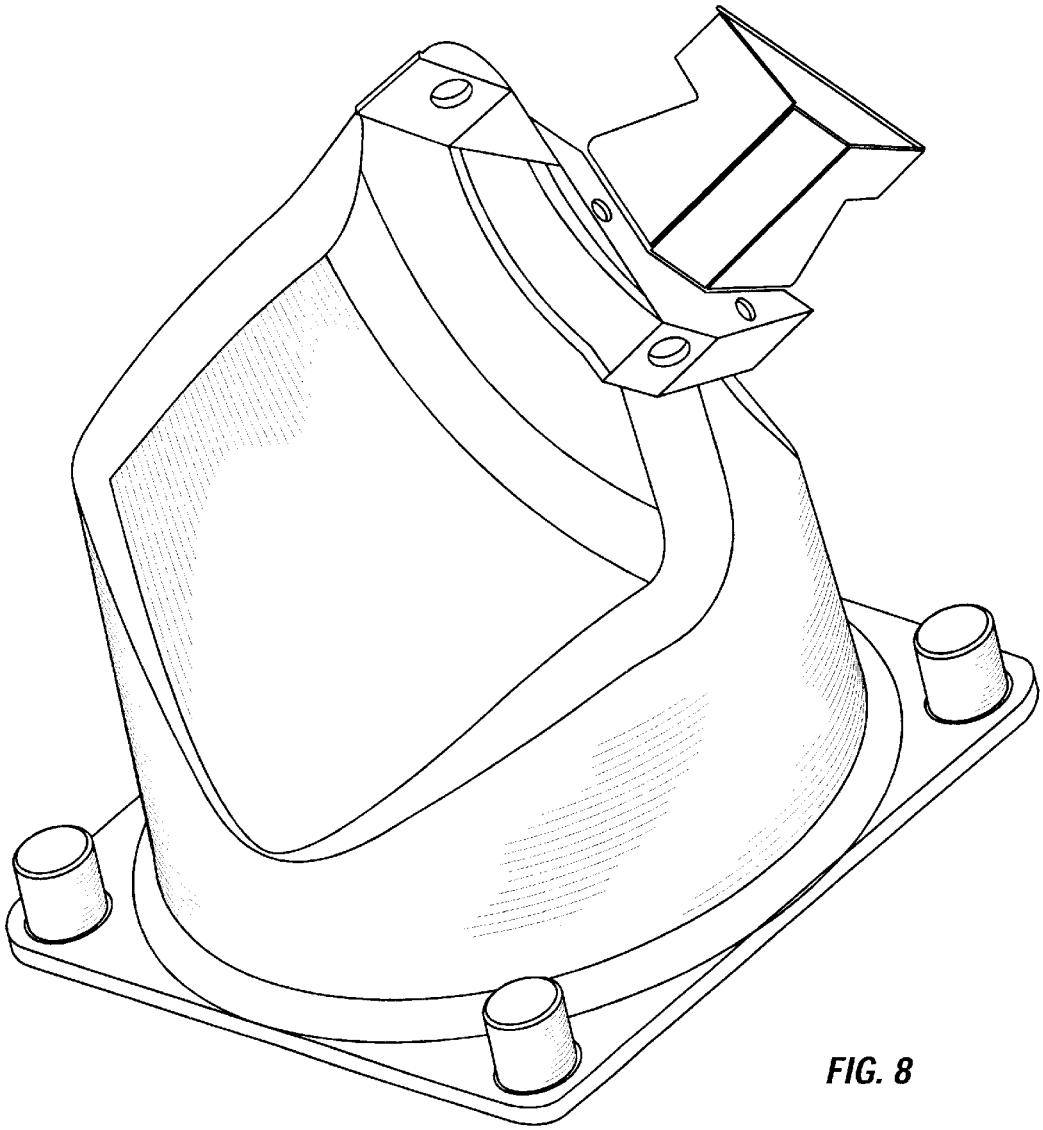
FIG. 8 shows the air interface assembly.

FIG. 8 shows a diagram of only the air producing assembly and the attachment to the air chimney. The fan assembly 310 comprises two separate fans mounted one on top of the other as shown. Fans 312 and 314 produce air at the same rate as one fan would have produced but at a higher air pressure.

Although only a few embodiments have been disclosed in detail, other embodiments are possible. All such modifications are intended to be encompassed within the following claims.

What is claimed is:

1. A lighting fixture, comprising:

a lighting reflector;

a lighting socket located within said lighting reflector;

a cooling air aperture, extending into an inside of said lighting reflector, and configured to cool only a specified area within said lighting reflector, wherein said cooling air aperture includes a device with inner surfaces defining a channel for air to first flow in a first direction, and to second flow in a second direction which is in a generally different direction than said first direction.

2. A fixture as in claim 1, further comprising a fan, forming said cooling air.

3. A lighting fixture, comprising:

a lighting reflector;

a lighting socket located within said lighting reflector;

a cooling air aperture, extending into an inside of said lighting reflector, and configured to cool only a specified area within said lighting reflector;

a fan, forming a stream of cooling air, and directing said cooling air to said cooling air aperture.

4. A fixture as in claim 3, further comprising a cavity, containing air which has been forced by said fan.

5. A fixture as in claim 4, wherein one wall of said cavity is a generally curved shape which is curved in a way that mates with a curvature of said lighting reflector.

6. A lighting fixture, comprising:

an optical reflector, having a first reflecting part, and a second non reflecting part;

a bulb socket, formed in said second non reflecting part; and a cooling air chimney portion, extending from a first point outside said optical reflector, to a second point inside said optical reflector, and forming a channel for cooling air inside said optical reflector that is directed along a confined path, inside said chimney portion, wherein said chimney portion includes an inner cavity extending generally along a first direction, and an end portion which deflects cooling air from said first direction to a second direction generally toward said bulb, away from said first direction.

7. A lighting fixture, comprising:

an optical reflector, having a first reflecting part, and a second non reflecting part;

a bulb socket, formed in said second non reflecting part;

a cooling air chimney portion, extending from a first point outside said optical reflector, to a second point inside said optical reflector, and forming a channel for cooling air inside said optical reflector that is directed along a confined path, inside said chimney portion; and a bulb, connected to said socket, said bulb having a first portion with a first temperature requirement, and a second portion with a second temperature requirement, wherein said second portion has a temperature requirement which avoids the need for cooling, and said first portion requires cooling.

8. A fixture as in claim 7, wherein said chimney portion directs air only to said first portion of said bulb.

9. A fixture as in claim 8, wherein said chimney portion is located in a location such that does not block any light from said bulb from reaching said reflector.

10. A fixture as in claim 8, wherein said chimney portion is sized such that it does not block any light from said bulb from reaching said first reflecting part of said reflector.

11. A lighting fixture, comprising:

an optical reflector;

a fixture for a bulb which produces light which is to be reflected by said optical reflector; and a cooling air portion, located in a location inside said optical reflector where it will not interfere with light being produced by said bulb and coupled to said optical reflector and which directs air in a direction that is toward a first area and away from another area inside said optical reflector.

12. A fixture as in claim 11, wherein said cooling air portion is formed of bent sheet metal, and extends generally along a first direction.

13. A fixture as in claim 12, further comprising a bulb, coupled to said fixture for said bulb, and extending generally along said first direction substantially parallel with said cooling air portion.

14. A fixture as in claim 11, further comprising a bulb having said first area which requires cooling and said second area which does not require cooling.

15. A fixture as in claim 11, further comprising a fan producing cooling air to be coupled to said cooling portion.

16. A fixture as in claim 15, wherein said fan comprises a first fan on top of a second fan, said first and second fans collectively producing said cooling air.

* * * * *